United States Patent [19]

Wang

[11] Patent Number: 4,479,541

[45] Date of Patent: Oct. 30, 1984

[54] METHOD AND APPARATUS FOR RECOVERY OF OIL, GAS AND MINERAL DEPOSITS BY PANEL OPENING

[76] Inventor: Fun-Den Wang, c/o Elektra Energy Corp., 340 N. Belt E., Houston, Tex. 77060

[21] Appl. No.: 410,391

[22] Filed: Aug. 23, 1982

[51] Int. Cl.[3] ..... E21B 43/16

[52] U.S. Cl. ..... 166/268; 166/50; 166/52; 166/223; 299/16; 175/67

[58] Field of Search ..... 166/268, 271, 222, 223, 166/245, 50, 52; 299/17, 16, 4

[56] References Cited

U.S. PATENT DOCUMENTS

| | | | |
|---|---|---|---|
| 1,816,260 | 7/1931 | Lee | 166/50 |
| 2,188,737 | 1/1940 | Hixon | 166/52 |
| 3,810,510 | 5/1974 | Fitch et al. | 166/271 |
| 3,878,884 | 4/1975 | Raliegh | 166/271 |
| 4,140,182 | 2/1979 | Vriend | 166/271 |

*Primary Examiner*—Stephen J. Novosad
*Assistant Examiner*—Mark J. Del Signore

[57] ABSTRACT

A method for oil, gas and mineral recovery by panel opening drilling including providing spaced injection and recovery drill holes (10, 12) which respectively straddle a deposit bearing underground region (20), each drill hole including a panel shaped opening (18, 19) substantially facing the deposit bearing region (20) and injecting the injection hole (10) with a fluid under sufficient pressure to uniformly sweep the deposits in the underground region to the recovery hole (12) for recovery of the deposits therefrom. An apparatus (50) for creating such panel shaped is also provided.

16 Claims, 15 Drawing Figures

METHOD AND APPARATUS FOR RECOVERY OF OIL, GAS AND MINERAL DEPOSITS BY PANEL OPENING

BACKGROUND OF THE INVENTION

This invention relates to a new method of oil production through the use of a single or a series of panel openings located within or near the reservoir. Oil and gas production have been based on the use of drill hole or drill holes in the reservoir for their recovery. For a given reservoir, with a specific pressure, fluid and rock properties, the production rate is determined by the total exposed area of the reservoir by the drill hole or drill holes. This production rate is described by Darcy's Equation. Hydrofracturing of the drill hole is a well established technique which is used to increase the production area and thereby to increase the production rate. However, maintaining a long term stability of the gap of the fracture even with sand fill is difficult. This difficulty is evidenced by the fast reduction of production rate following the hydrofracturing process.

In the many enhanced oil recovery processes, such as water flooding using water or polymer, thermal recovery with steam or in-situ combustion and carbon dioxide flooding, multiple wells are employed for oil production. The flow of water or fluid from one well to the other tends to form some combination of tongues and fingers or non-uniform flow. This phenomenon reduces the efficiency of production and recovery ratio.

It is therefore an object of the invention to provide increased oil production in a manner overcoming the above pitfalls.

SUMMARY OF THE INVENTION

The present invention comprises a method and apparatus which employs panel openings in place of a single or multiple drill holes for both primary and enhanced recovery. Because of large area of the panel opening and even pressure therein, uniform flow can be obtained with high flow rate and recovery ratio.

This invention features a method for producing such panels including providing spaced injection and recovery drill holes which respectively straddle a deposit bearing underground region. Each drill hole includes a panel shaped opening substantially facing the deposit bearing region. The panel openings may actually be in a large composite deposit bearing region or may alternatively proximately bound a discrete region. The injection drill hole is injected with a fluid under sufficient pressure to uniformly sweep the deposits in the underground region to the recovery hole for recovery of the deposits therefrom. When a single panel opening is used, the panel opening with its drill hole is used for the recovery of oil and fluids.

Various arrangements of injection and recovery panel openings may be provided. For example, an injection hole may have multiple complementary recovery holes and may thus feed multiple deposit bearing regions. A recovery hole may be fed from multiple injection holes via multiple deposit bearing regions. Drill holes may be disposed vertically, horizontally or oblique to the surface of the earth. The complementary injection and recovery panel openings may be parallel or nonparallel but will never intersect. Rectangular, oval, circular or other panel cross sectional shapes may be provided.

This method is equally applicable to oil shale, and tar sand recovery as well as in-situ leaching of minerals such as uranium. It also can be used to serve as a curtain for the control of ground water contamination.

An apparatus for creating the heretofore described panel openings is also featured. This apparatus includes means defining an elongate pipe having at least one longitudinal orifice for conducting pressure fluid therethrough. There are means defining a cylinder disposed with the pipe and having an axial bore communicable with at least one pipe orifice and means defining a piston contained within the cylinder bore and being advanceable therein in response to sufficient fluid pressure being introduced into the cylinder bore. There is at least one elongate expandable arm pivotably connected to the bottom end of the pipe and having a longitudinal channel extending therethrough which is communicable with at least one pipe orifice. There are jet means proximate the distal end of each arm. There are means interconnecting the piston with each expandable arm such that each arm is pivotable between a retracted condition when the piston is retracted within the cylinder bore and an expanded condition when the piston is advanced within the bore. Fluid injected into the pipe orifice is transmitted via each channel and sprayed from each jet for cutting through underground material from the drill hole and introduced into the cylinder for advancing the piston and thereby causing the expandable arms to expand through a desired underground zone as the material thereof is cut thereby forming a panel opening in the zone.

In a preferred embodiment the pipe is longitudinally oscillatable in the drill hole for spraying and thus cutting underground material bordering discrete longitudinal segments of the drill hole thereby enabling expansion of the arms through an underground zone comprising such cut underground material. The apparatus may also be rotatable within the drill hole for forming three dimensional openings, i.e. caverns of spherical, cylindrical, ovoidal, rectangular or other shapes. Typically the apparatus will include two expandable arms.

The pipe may include a return duct for conducting exhausted fluid and cuttings therethrough. The pipe may include a single axial orifice and such an apparatus may also include an elongate tube having a longitudinal return duct as described, such a tube being concentrically disposed within the pipe orifice. Pump means will be provided to pump exhaust fluid and cut waste material through the return duct. Alternatively, a gap may exist between the pipe and the drill hole through which such waste may be conducted.

Other objects, features and advantages of the invention will be apparent from the following description of preferred embodiments with reference therein to the accompanying drawing in which:

DETAILED DESCRIPTION OF PREFERRED EMBODIMENTS

Figure 1:
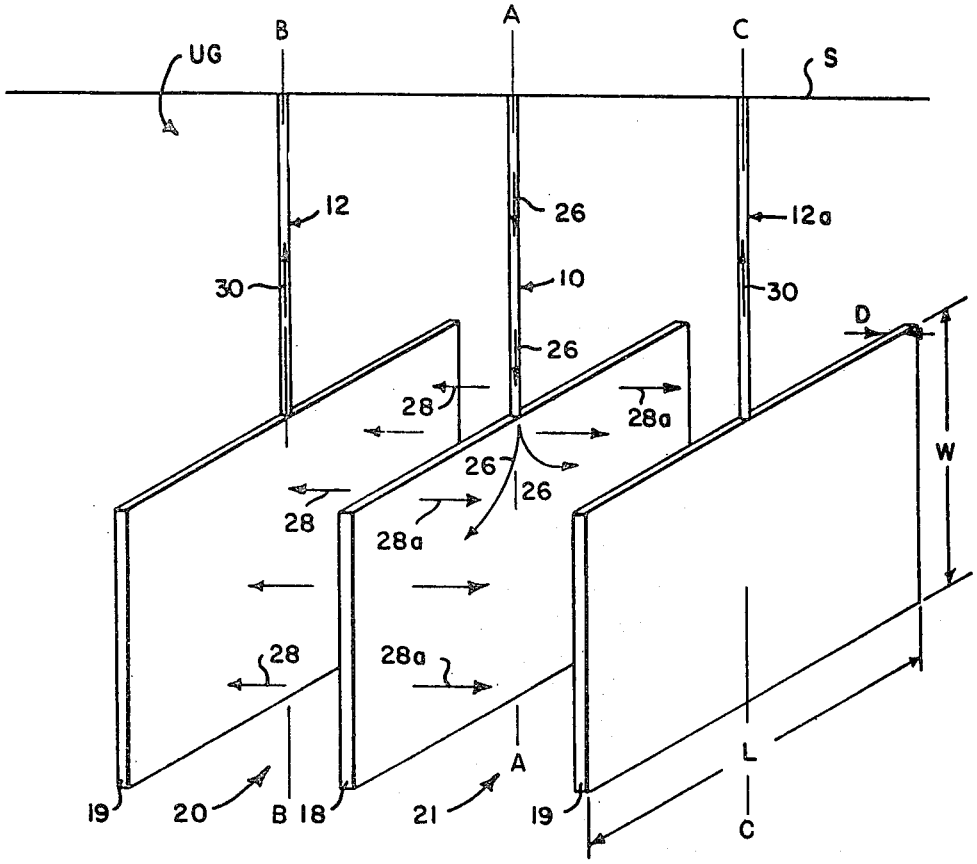
FIG. 1 shows a preferred manner of using panel opening drill holes, to recover underground deposits according to the method of this invention.

In accordance with the principles of this invention, as shown in FIG. 1, an alternating arrangement of injection drill holes 10 (only one shown) and recovery drill holes 12, 12*a* is provided extending from surface 5 along respective longitudinal axes A—A, B—B, and C—C into an underground area U.G. A panel opening 18 is created at the base of each such injection drill hole 10 and a similar panel opening 19 is provided at the base of holes 12, 12*a* and adjacent panels are arranged substantially parallel. The depth D of each such opening is small relative to the length L and width W (i.e. on the order of several inches to several feet depth versus several tenth or hundred feet L and W) hence giving rise to the term panel opening. Each pair of adjacent drill holes 10 and 12 and 10 and 12*a* straddle a deposit bearing region 20, 21 in the underground are U.G. Such deposit bearing regions 20, 21 may comprise a single composite deposit bearing region into which the openings 18, 19 extend. Alternatively the deposit bearing regions 20, 21 may be distinct regions (i.e. each containing discrete mineral oil or gas deposits) between each pair of adjacent panels.

Note that panel openings 18 are pictured as having a rectangular cross section. The panel opening of this invention is not limited such a shape and may alternatively be oval, circular or any other shape.

Each panel opening 18 or 19 substantially faces the deposit bearing region 20, 21 disposed between it and the parallel adjacent drill hole panel opening. For example, both opening 19 of recovery drill hole 12 and opening 18 of injection drill hole 10 face deposit bearing zone 20.

the recovery of in-situ deposits may be accomplished by injecting hole 10 with a fluid under pressure, as included by arrow 26. Fluid under uniform pressure emerges from both faces of panel 18 of hole 10. A resulting uniform fluid flow 28 sweeps through region 20 and a similar fluid flow 28*a* sweeps through region 21. Deposits in these regions are swept to panel openings 19 of drill holes 12 and 12*a* respectively. The deposit is then recovered from holes 12, 12*a* as indicated by arrows 30 in any conventional manner. The broad uniform flow sweeps exhibited by the method of this invention provide a greatly enhanced deposit recovery ratio.

Figure 2:
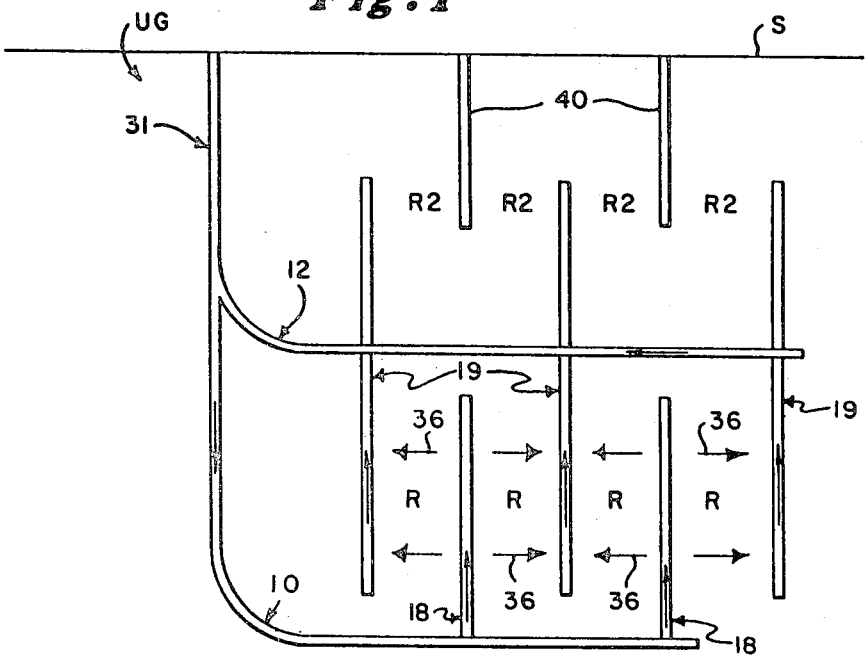
FIGS. 2–5 are alternative arrangements of panel opening drill holes provided according to the method of this invention.

A wide variety of panel arrangements may be provided in order to adapt this process to varying deposit conditions (i.e. location, configuration, nature, etc. of the deposit). For example in FIG. 2 a single vertical drill hole 31 branches into a distinct horizontal injection and recovery holes 10, 12. A number of vertical injection panel openings 18 transverse hole 10 and a similar arrangement of recovery panel openings transverse hole 12. Fluid is injected under pressure into hole 10 and such fluid exits panel openings 18 and sweeps through deposit bearing regions R as indicated by arrows 36, thereby sweeping deposits to recovery panel openings 19 for recovery up hole 12. Note also that injection panel openings 40 may be provided from the surface S for sending a similar uniform pressure fluid flow toward recovery panels 19 when recoverable deposits are present in regions R2.

Figure 3:
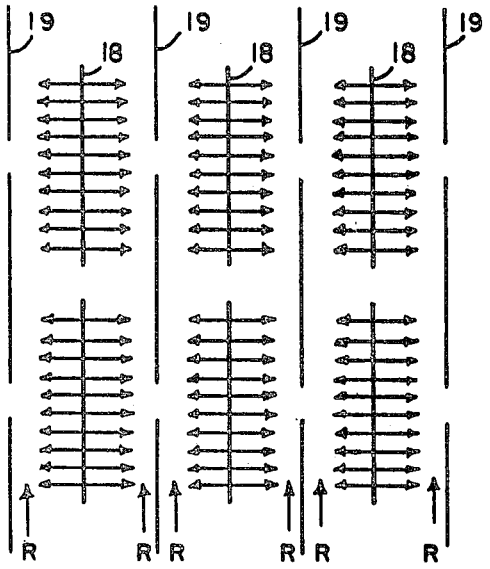

As shown in FIG. 3 an alternating arrangement of aligned injection panel openings 18 and aligned recovery panel openings 19 may be provided wherein the injection and recovery panels are staggered with respect to each other. As illustrated in FIG. 3, the basic arrangement of three staggered panels includes two panels substantially aligned in a common plane (e.g., panel 19) and a third panel (e.g., panel 18) spaced from and substantially parallel to the common plane. The third panel (e.g., panel 18) of the basic three panel arrangements has portions overlapping respective portions of the first and second panels (e.g., panel 19). The drill hole to the third panel (e.g., panel 18) can then be the injection hole whereby the deposit is uniformly swept from the third panel (e.g., panel 18) to the first and second panels (e.g., panel 19) for recovery. Alternately, the basic unit of three panels can involve two injection holes leading to two aligned panels (e.g., panel 18) whereby the two panels are used to uniformly sweep the deposit to the third panel (e.g., panel 19) for recovery. Also, upon the inclusion of fourth and fifth panels in the basic unit and expanding the pattern as desired, each injection hole and panel 18 can be used to feed four recovery panels 19 or correspondingly, each recovery hole and panel 19 can be fed by four injection holes and panels 18. Each panel containing drill hole faces a pair of deposit bearing regions R (which again may comprise a single deposit zone).

Figure 4:
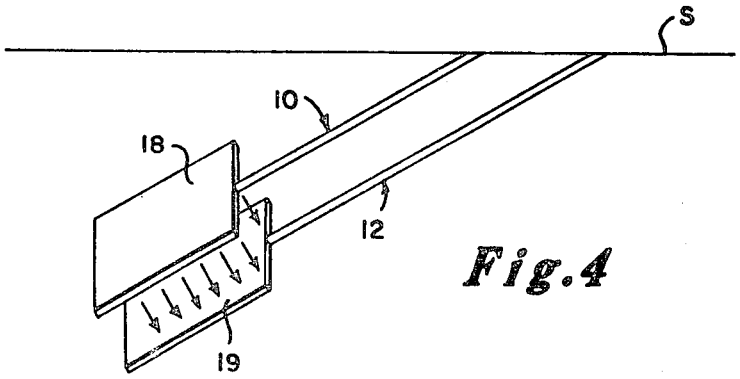
Figure 5:
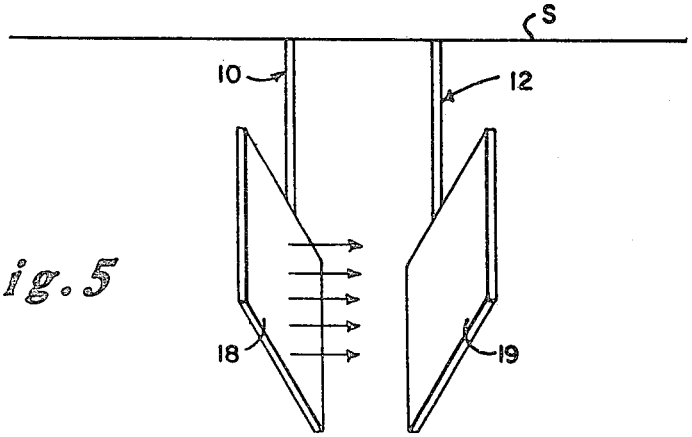

As shown in FIG. 4 drill holes 10, 12 may be provided oblique to the surface S. Further, as shown in FIG. 5 adjacent injection and recovery panels 18, 19 may be nonparallel. In each of the embodiments heretofore described high recovery rates commensurate with the objects of this invention are achieved.

Due to the large area of the panel openings, the rate of oil production can be much increased as compared to small drill holes. At the same time, the recovery ratio of oil is greatly improved because of the uniform pressure which may be applied in the panel opening, and the total coverage of reservoir between adjacent panels.

Figure 6:
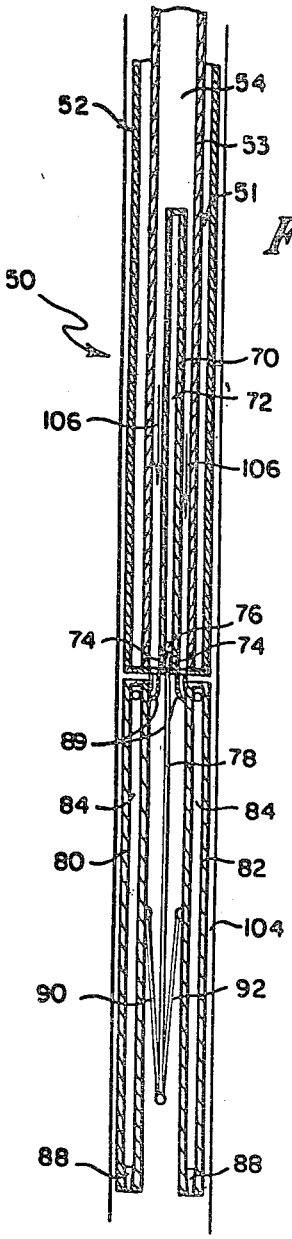
FIG. 6 is an elevated cross sectional view of an apparatus for creating panel opening drill holes shown in a drill hole prior to forming a panel opening.
Figure 8:
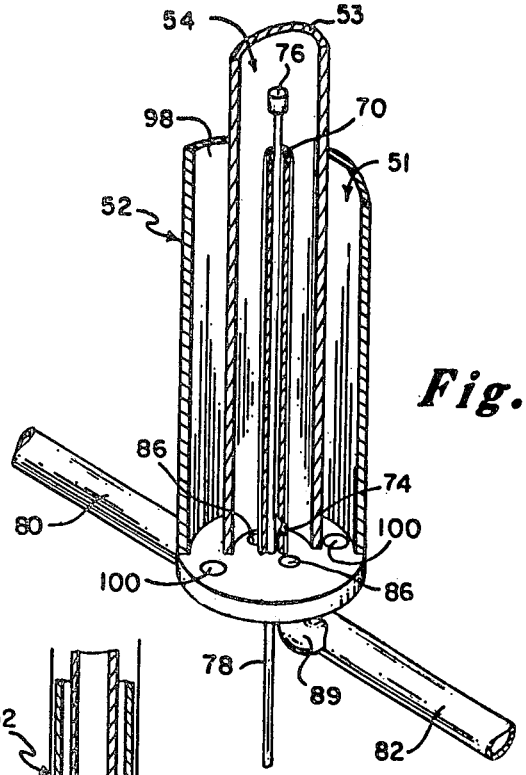
FIG. 8 is an isometric cross sectional view of the apparatus of FIG. 7.
Figure 7:
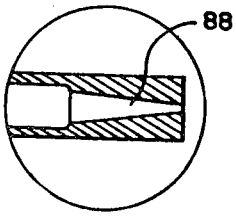
FIG. 7 is an elevated sectional view of the apparatus of FIG. 6 shown in an expanded condition following formation of a panel opening and FIG. 7A is a cross section thereof taken along line 7A—7A of FIG. 7.
Figure 7:
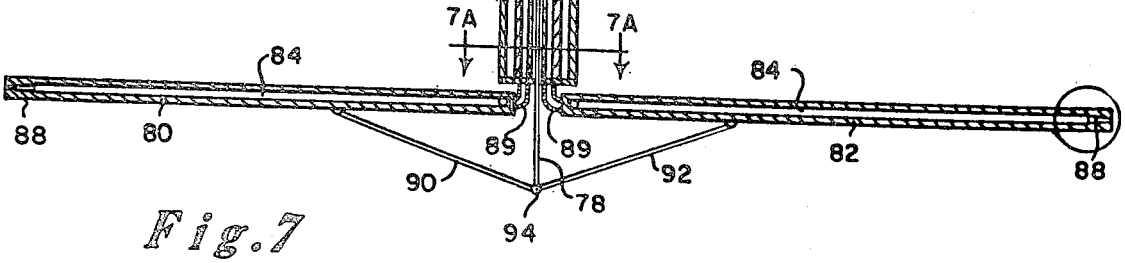

There is shown in FIGS. 6–8 a cutting apparatus or tool (e.g., jetting tool) 50 for providing the panel opening drill holes of this invention.

Figure 7A:
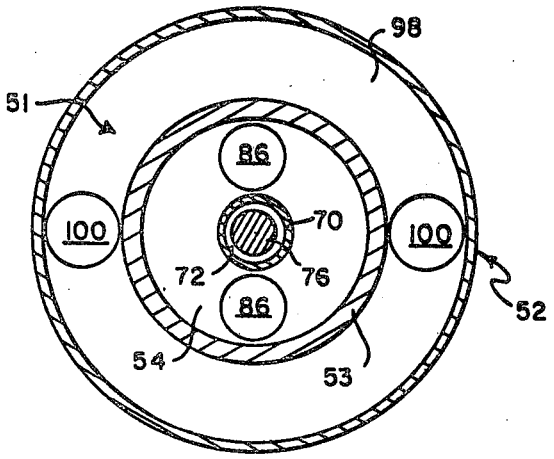

As best shown in FIG. 7A an elongate pipe 52 includes a bore 51 having an inner pipe 53 disposed therein. Pipe 53 includes an orifice 54 for conducting a pressure fluid downwardly therethrough.

Figure 10:
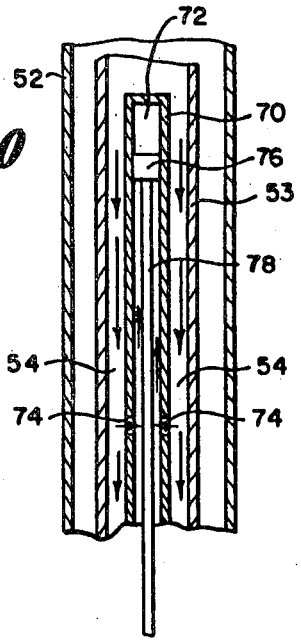
FIG. 10 is an elevated cross sectional view of the cylinder and piston combination of this invention.

A cylinder 70 shown alone in FIG. 10 is centrally disposed in pipe 53 proximate the bottom end thereof. Cylinder 70 includes an axial bore 72 and ports 74 which communicate with pipe orifice 54. A piston 76 is contained within cylinder bore 54 and is connected to a connecting rod 78.

Figure 9:
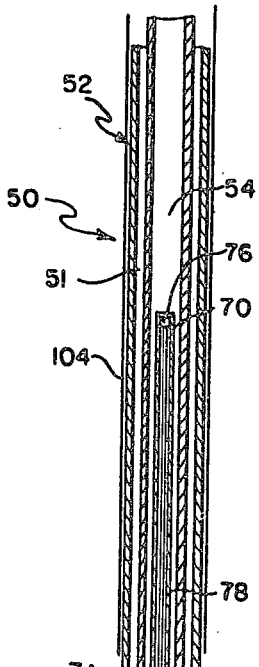
FIG. 9 is an enlarged view of the jet nozzle.
Figure 11:
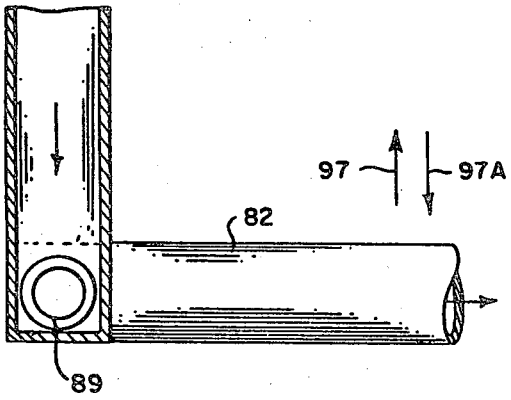
FIGS. 11 and 11A illustrate details of the swivel joint of the apparatus.
Figure 11A:
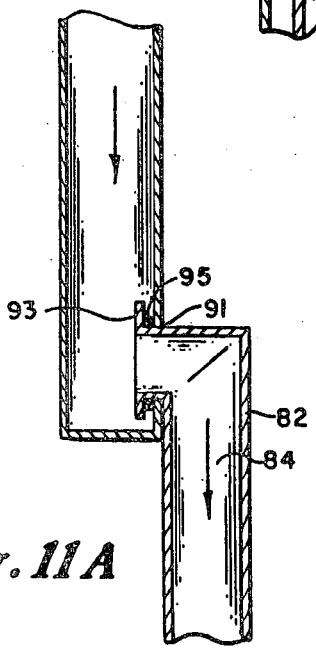

Expandable arms 80, 82 are pivotably connected to pipe 52 via one of a variety of swivel joints 89, such varieties shown in FIGS. 6 and 7, FIG. 8 and FIGS. 11, 11A. A typical manner of connecting the extension pieces and expandable arms is shown in FIGS. 11, 11A. As shown in FIG. 11A the inner end of arm 82 (and omitted arm 80) extends into pipe extension piece 81 through a hole 91 and includes a flange 93 to prevent removal of the arm 82 from the pipe extension piece 81. An annular seal 95 is interposed between flange 93 and the wall of pipe extension piece 81. Arm 82 is thereby pivotable in the directions of arrows 97, 97A. Each arm has a longitudinal channel 84 extending therethrough which is communicable via a bore 83 and a port 86 with pipe orifice(s) 54 and which terminates at a jet nozzle 88, shown alone in FIG. 9, at the distal end of the arm. The jet nozzles are arranged in such a way that they are pointed normally in the axial direction of and also may be 45 degrees off from the axial direction of the expanding arms 80, 82.

Connecting rod 78, FIG. 7, is pivotably connected to actuator rods 90, 92 at pivot 94. Rods 90 and 92 are themselves also pivotably connected to expandable arms 80, 82 respectively.

As shown in FIGS. 7A, 8 bore 51 forms a return duct 98 between concentric pipes 52 and 53. By means of ports 100, in the bottom of pipe 52 duct 98 communicates with the hole 104 being drilled.

In operation, FIGS. 6, 7, an elongate, typically circular cross sectional drill hole 104 is drilled by standard means. With drill apparatus 50 in the position indicated in FIG. 6 within hole 104 fluid is injected at high pressure into orifice 54. As indicated by arrows 106 the fluid flows through orifice(s) 54, ports 86, bores 83 of pieces 81 and channels 80 and 82. Fluid is sprayed out of jets 88 and the side wall W bordering hole 104 is cut such as at points 110. By longitudinally oscillating apparatus 50 in the direction of arrows 112 and 114 respectively, a discrete segment 116 of the bordering wall is cut by each jet 88 forming panels of predetermined shapes, sizes, and orientations such as 18, 19, and 152 (see FIGS. 1,2,4,5 and 13) and by rotating and/or oscillating apparatus 50 about and along the longitudinal axis of drill hole 104 in FIG. 12, other cavities of various predetermined shapes, sizes, and orientations such as 154 can be formed.

Fluid also enters bore 72 of cylinder 70 via ports 74, as shown most clearly in FIG. 10. Such pressure fluid urges piston 76 to advance as shown within cylinder 70. Consequently connecting rod 78 is likewise urged to advance actuating rods 90, 92 which are urged to spread outwardly into a lateral position. Expandable arms 80, 82 are thus urged into an expanded lateral state. Such expansion is resisted by the surrounding hole wall W. Fluid is sprayed out of jets 88 and the side wall W bordering hole 104 is cut such as at points 110. By longitudinally oscillating apparatus 50 in the direction of arrows 112 and 114 respectively a discrete segment 116 of the bordering wall is cut by each jet 88. As the wall is cut deeper by jets 88 the resistance to the above described expansion of arms 80 and 82 is reduced. Consequently repeated oscillation of drill 50 enables arms 80 and 82 to expand through the cut underground material to the lateral position shown in FIG. 7. A panel such as previously described is thus formed with exhausted fluid and cut material being pumped, for example, through ports 100 and up return duct 98 (see FIG. 8) for disposal.

Figure 12:
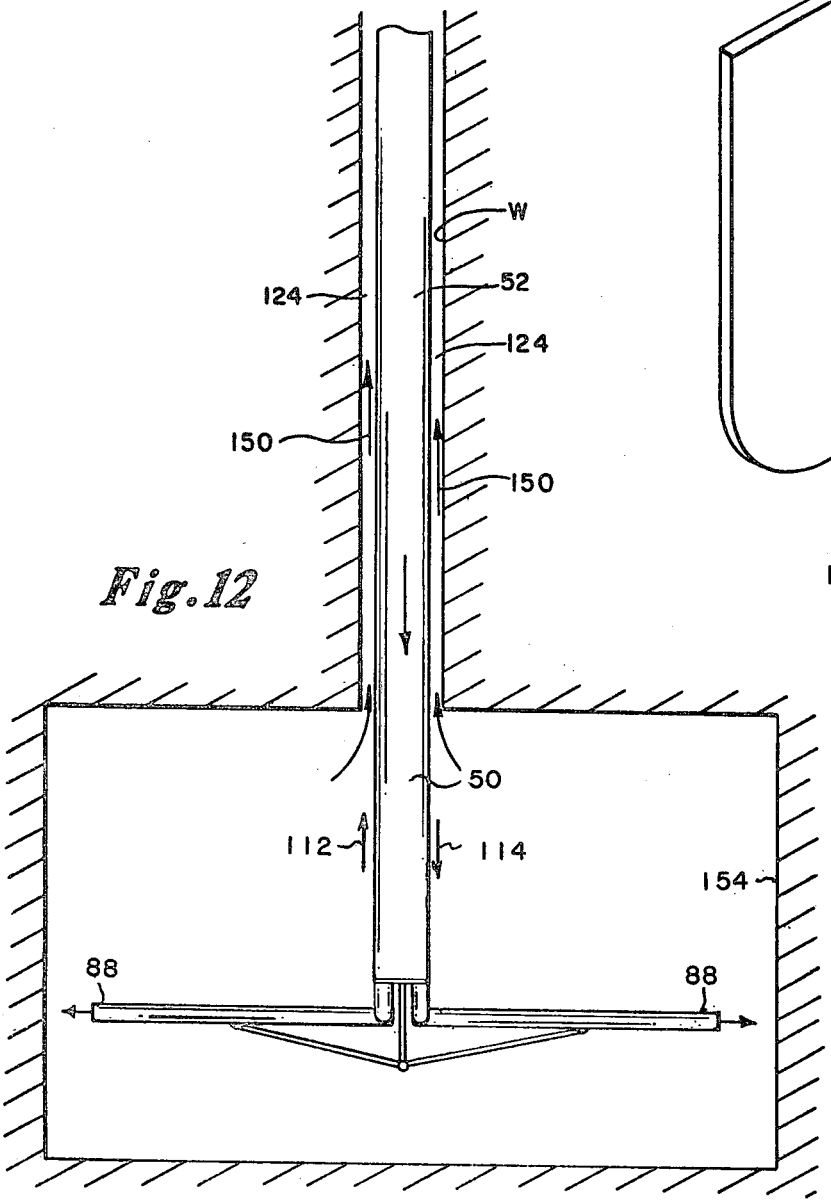
FIG. 12 illustrates a cavity formed by rotating the apparatus of this invention within the drill hole.
Figure 13:
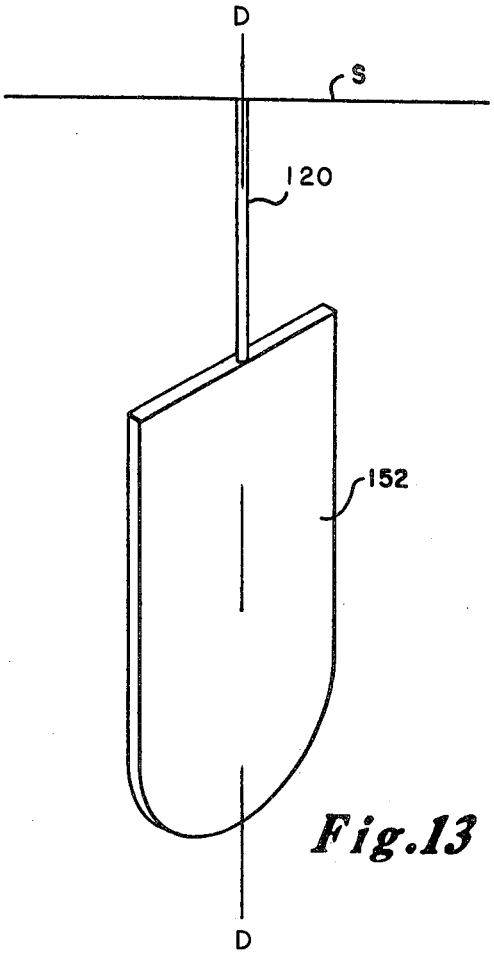
FIG. 13 illustrates a cavity formed by oscillating the apparatus along the axis D—D of the drill hole 120.

In an alternative embodiment, FIG. 12, exhausted fluid and cut material are returned as shown by arrows 150 via the gap 124 between pipe 52 and the hole wall W. Note that in such an embodiment no inner tube and return duct are provided.

It is evident that those skilled in the art, once given the benefit of the foregoing disclosure, may now make numerous other uses and modifications of, and departures from, the specific embodiments described herein without departing from the inventive concepts. Consequently, the invention is to be constructed as embracing each and every novel feature and novel combination of features present in, or possessed by, the apparatus and techniques herein disclosed and limited solely by the spirit and scope of the appended claims.

What is claimed is:

1. Method for oil, gas and mineral recovery by panel opening drilling comprising:

(a) providing spaced apart injection and recovery drill holes extending along respective longitudinal axes into an underground area having a deposit bearing region, (b) drilling a first panel shaped opening outwardly of the injection hole by cutting the underground area adjacent the injection hole, said first panel shaped opening substantially facing the deposit bearing region, and (c) injecting said injection hole with a fluid under sufficient pressure to uniformly sweep the deposits in the underground area to said recovery hole for recovery of the deposits therefrom.

2. Method for oil, gas and mineral recovery by panel opening drilling comprising:

(a) providing at least first, second, and third spaced apart drill holes extending along respective longitudinal axes into an underground area having a deposit bearing region, (b) drilling a panel shaped opening outwardly of each respective drill hole by cutting the underground area adjacent each drill hole, said panel shaped openings being spaced from one another and substantially parallel to one another with two of said openings being aligned substantially in a common plane and the third opening being spaced from and substantially parallel to said common plane, said third opening having portions thereof overlapping respective portions of the other two openings, at least one of said holes being an injection hole and at least another of said holes being a recovery hole, and (c) injecting a fluid into said at least one injection hole under sufficient pressure to uniformly sweep the deposits in the underground area to said at least one recovery hole for recovery of the deposits therefrom.

3. Method in accordance with either of claims 1 or 2 wherein at least one of said drill holes is substantially vertical.

4. Method in accordance with either of claims 1 or 2 wherein at least one of said drill holes is substantially horizontal.

5. Method in accordance with either of claims 1 or 2 wherein at least one of said drill holes is oblique.

6. The method of claim 1 wherein step (b) includes the further limitation that said first opening is of a predetermined shape.

7. The method of claim 1 wherein step (b) includes the further limitation that said first opening is of a predetermined shape and size.

8. The method of claim 1 wherein step (b) includes the further limitation that said first opening is of a predetermined shape, size. and orientation relative to the longitudinal axis of the injection hole.

9. The method of claim 1 wherein step (b) includes the further limitations of providing a cutting tool and oscillating said cutting tool along said longitudinal axis of said injection hole to drill said first opening in said underground region outwardly of and adjacent to said injection hole.

10. The method of claim 9 further including the limitation of rotating said cutting tool about said longitudinal axis to drill said first opening.

11. The method of claim 9 wherein said cutting tool is a jetting tool.

12. The method of claim 1 further including the step of drilling a second panel shaped opening outwardly of the recovery hole by cutting the underground area adjacent the recovery hole, said second panel shaped opening substantially facing the deposit bearing region and said first panel shaped opening.

13. The method of claim 2 wherein the openings of said first and second drill holes are the two openings aligned in said common plane, said third drill hole is the injection hole and said first and second drill holes are both recovery holes whereby said one injection hole feeds both of said recovery holes.

14. The method of claim 2 wherein the openings of said first and second drill holes are the two openings aligned in said common plane, said third hole is the recovery hole and said first and second holes are both injection holes whereby said one recovery hole is fed by two injection holes.

15. The method of claim 2 further including the steps of providing fourth and fifth drill holes extending along respective longitudinal axes into said underground area, drilling a panel shaped opening outwardly of the respective fourth and fifth drill holes by cutting the underground area adjacent the fourth and fifth drill holes, said panel shaped openings of said fourth and fifth drill holes being spaced from one another and substantially parallel to each other and substantially aligned in a second common plane spaced from and parallel to said first common plane, said fourth and fifth openings have respective portions thereof overlapping respective portions said third opening wherein the openings of said first and second drill holes are the two openings aligned in the first mentioned common plane, said third drill hole is the injection hole and said first, second, fourth, and fifth drill holes are all recovery holes whereby said one injection hole feeds all four of said recovery holes.

16. The method of claim 2 further including the steps of providing fourth and fifth drill holes extending along respective longitudinal axes into said underground area, drilling a panel shaped opening outwardly of the respective fourth and fifth drill holes by cutting the underground area adjacent the fourth and fifth drill holes, said panel shaped openings of said fourth and fifth drill holes being spaced from one another and substantially parallel to each other and substantially aligned in a second common plane spaced from and parallel to said first common plane, said fourth and fifth openings have respective portions thereof overlapping respective portions said third opening wherein the openings of said first and second drill holes are the two openings aligned in the first mentioned common plane, said third drill hole is the recovery hole and said first, second, fourth, and fifth drill holes are all injection holes whereby said one recovery hole is fed by all four of said injection holes.

* * * * *